United States Patent [19]

Trimble

[11] 4,161,998

[45] Jul. 24, 1979

[54] FIRE ESCAPE DEVICE

[76] Inventor: Richard C. Trimble, 1600 Gateway East #175, Richmond, Va. 23229

[21] Appl. No.: 863,422

[22] Filed: Dec. 22, 1977

[51] Int. Cl.[2] ..... E06C 1/36; E06C 1/56; A63B 7/04

[52] U.S. Cl. ..... 182/190; 182/100; 182/196; 182/228; 272/85; 272/112

[58] Field of Search ..... 182/190, 196, 100, 189, 182/228; 272/85, 110, 112

[56] References Cited

U.S. PATENT DOCUMENTS

| | | | |
|---|---|---|---|
| 285,806 | 10/1883 | Foster | 182/190 |
| 707,715 | 8/1902 | Parker | 182/190 |
| 995,159 | 6/1911 | Lansden | 182/190 |
| 3,294,196 | 12/1966 | Rabelos | 182/190 |
| 3,642,277 | 2/1972 | Gersten | 182/190 |

*Primary Examiner*—Reinaldo P. Machado
*Attorney, Agent, or Firm*—Joseph P. Nigon

[57] ABSTRACT

A fire escape, exercise or amusement device designed to depend vertically from a wall when in use and to have sufficient flexibility to simplify storage is disclosed. The device consists of a rope-like support member with a series of beads about 4 to 5 inches in diameter spaced axially along substantially the entire length of the rope-like support. A grasping hook is attached to at least one end of the device for attachment to a support that is an integral part of a building or other structure. Horizontal rods are attached to the top and bottom of the device above and below the beads.

9 Claims, 5 Drawing Figures

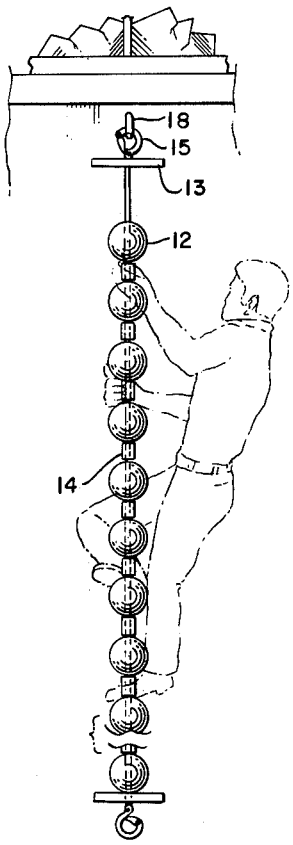

FIRE ESCAPE DEVICE

BACKGROUND OF THE INVENTION

Fire escape devices that are flexible, or partially flexible, and are designed to be attached to a building to enable the occupants of the building to descend to a lower floor or to the ground are well known. Most of these structures are rope ladders or are pieces of rope that are attached to the interior of the building near a window so that they can be dropped out of the window and used by the occupant to make his descent.

There is also a body of art showing flexible or semi-flexible devices used as toys or exercising devices. U.S. Pat. No. 3,642,277 discloses a semi-flexible rope-type article that is used as a jump rope or as an exercising device. A series of cylindrical members are positioned along the entire length of the device. U.S. Pat. No. 3,782,718, discloses a rope climbing machine in which a rope is moved at a predetermined speed to allow a climber to climb up or down the rope while remaining close to the floor. U.S. Pat. No. 3,643,942, discloses a play device in which rotatable plastic balls are positioned on a dowel extending from the top to the bottom of the sides of the structure. U.S. Pat. No. 1,676,061, discloses an exercise device which consists of a rope with a series of knots therein attached to a horizontally extending support member.

SUMMARY OF THE INVENTION

It has now been found that a serviceable fire escape, exercise or amusement device, that is designed to be hooked over a support member attached to a wall, can be made attaching a grasping hook to at least the top of an elongated flexible rope-like support. A multiplicity of beads, each 4 to 5 inches in diameter, are spaced axially along substantially the entire length of the flexible rope-like support. The beads are freely movable on the support. Horizontal rods having a length about twice the diameter of the beads are attached to the hook or to the rope-like support above and below the beads.

In the preferred embodiment, the hooks are attached to both the top and the bottom of the rope-like support member.

In another embodiment of the device, cylindrical members having a length about one-half to two times the diameter of the beads, are spaced axially along the entire length of the support between each of the beads.

The beads preferably have a roughened surface to improve their hand and foot traction. The hooks preferably have a hinged member closing the front of the hooks at all times except when they are being attached to or removed from the support. Although the beads are spaced axially along substantially the entire length of the rope-like support, it is essential that the support be very flexible when not in use, and rigid when being used.

DETAILED DESCRIPTION OF THE ILLUSTRATED EMBODIMENTS

My invention is described as a fire escape device, although obviously it can be used as an exercise or amusement device.

Figure 1:
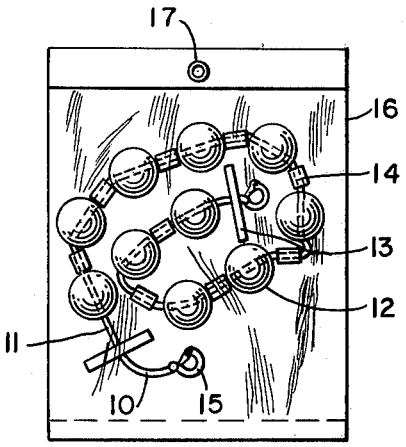
FIG. 1 illustrates the device of the present invention in a suitable storage container.

Referring now to FIG. 1 of the appended drawings, the fire escape device generally designated by the number 10, consists of a rope-like support member 11, with the beads 12 and the cross member 13 at the top and the bottom of the device attached thereto. It can be seen from the drawing that these cross members have a length roughly twice the diameter of the individual beads. In the embodiments shown in this figure, short members 14 are positioned between the beads. This figure shows the flexibility of the fire escape structure when it is not in use and shows it contained in a transparent bag 16, having an eyelet 17, at the top thereof, to facilitate attaching the device to a support on the wall of a room in a building.

Figure 2:
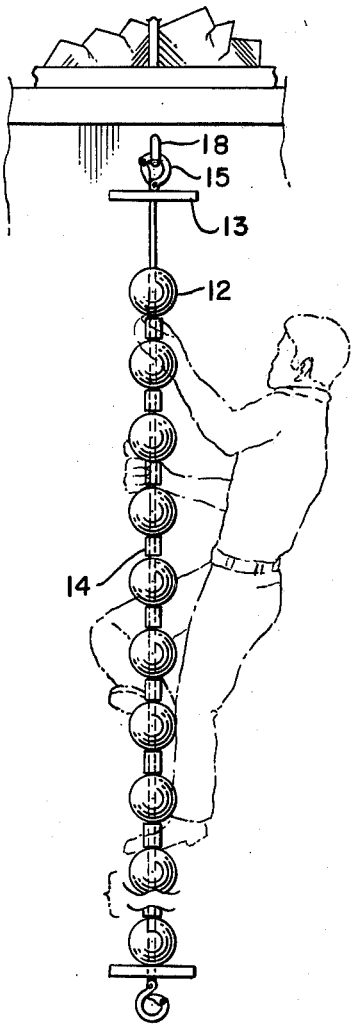
FIG. 2 illustrates one method of use of the fire escape, exercise, or amusement device.

FIG. 2 shows the fire escape device 10 attached to a hook 18 positioned on the side of a building (shown fragmentarily). The device is attached by means of a hook 15 at the upper portion of the rope-like support. A cross member 13 is shown as firmly attached in the area of the grasping hook member 15. The figure shows the embodiment which includes the beads 12 separated by cylindrical member 14.

It is apparent from this drawing that the beads are large enough to give a person moving down the fire escape device sufficient support for both his hands and feet to facilitate easy movement down the device. It is also apparent from this figure that the device is rigid when in use. The weight of the person using the device exerts a pressure on the beads and maintains the device rigid in the area below the bead supporting the user.

Figure 3:
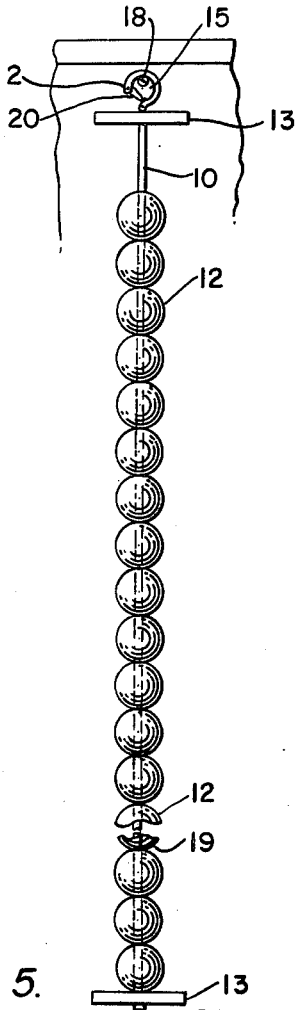
FIG. 3 shows the device attached to a support member on a building, and shows one of the beads and fragmentary section.

Referring now to FIG. 3, which shows another embodiment of the fire escape device 10 attached to a support member 18 on a side of a building (shown fragmentarily). The structure is attached by means of the hook 15. The cross members 13 are shown positioned at the top and the bottom of the device. This drawing also shows a detail of the beads 12 and shows that the beads are thick enough to support the weight of a person using the fire escape structure. If desired, a weighted material may be positioned in the inside of the beads as shown at 19. This drawing also shows the details of the hook 15 and shows the member 20 that is hinged into the hook at 21 and is in the closed position except when the hook is being attached to or detached from the building or from another fire escape device. This figure illustrates the embodiment of the invention wherein the cylindrical members positioned between the beads as shown in FIG. 2 are omitted.

In this embodiment the user can move the beads upwardly and grasp the rope-like support as he moves down the device.

Figure 4:
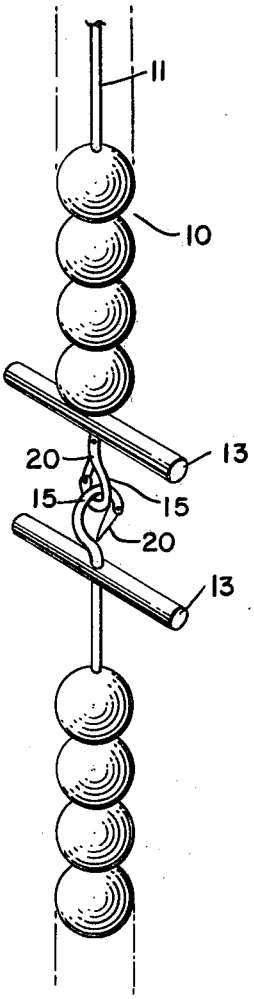
FIG. 4 is an illustration of an embodiment of the invention showing how a multiplicity of the structure can be attached together.

Referring now to FIG. 4 which shows the versatility of the fire escape device and shows that two or more of these devices can be easily attached one to the other to provide a fire escape device extending from the hook on the building at the top of the device to the ground.

This figure shows a fragment of the device 10 with the rope-like support member 11, and the horizontal members 13 attached to the hooks 15 having the closure structure 20. In this figure the hooks 15 are attached one to the other to provide an elongated structure.

Figure 5:
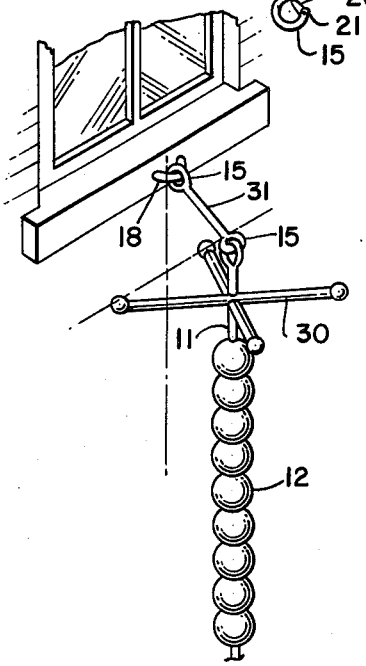
FIG. 5 illustrates an embodiment of the invention wherein an X shaped member is substituted for the cross members.

Referring now to FIG. 5 which shows an X shaped member 30 in perspective view attached to the device in place of the cross member 13. When the device is attached in this manner it is held away from the wall so it is necessary to include a short member 31 having two additional hooks 15 to attach the device to a wall. This X shaped member 30 may be attached to the hook 15 in any suitable manner such as with a screw thread, a clamp etc. It may be desirable to have structure 13 and 30 be interchangeable by providing an interchangeable attachment means such as screw threads on the hook and threads in the hole in the center of the X shaped member 30 and in the cross member 13, for example. Although the element 30 is shown as an X shaped member, it is obvious that a square, circular or member of any other suitable configuration may be used.

The rope-like support member can be rope, nonflammable plastic, wire or cable. It is obvious that the cross members 13 can be either tubes or rods. The beads 12 can be phosphorescent, if desired, to facilitate locating the device in a darkened room. The beads can be made of any material, such as plastic, for example, that has sufficient strength to support the weight of a person using the device as shown in FIG. 2. They may of course be made of a lightweight metal of sufficient strength to support a person. The beads have preferably a roughened surface to improve the hand and foot grip characteristics of the device.

Although I have described my invention as a device in which the elements 12 are beads it is obvious that they may be blocks, pyramids or have any other suitable shape.

When my invention is used as an amusement device it may be attached to a ceiling, a wall or between two free standing members such as posts on a playground. Since the device is designed to be easily attached and detached it has obvious utility as a piece of playground equipment.

What is claimed is:

1. A fire escape device designed to depend vertically from a building comprising in combination a thin elongated flexible rope-like support of uniform diameter having a multiplicity of beads with holes bored therethrough, each about 4 to 5 inches in diameter spaced along substantially the entire length of said support, supporting each other, and freely movable thereon, horizontal rods having a length about two times the diameter of said beads attached to said rope-like support above and below said beads on said support, and grasping hook means attached to at least one end of said support for attachment of said fire escape device to a supporting means on a building.

2. The fire escape device according to claim 1 wherein said beads have a roughened surface to improve the hand and foot traction thereof.

3. The fire escape device according to claim 1 wherein cylindrical member having a length of about one half to two times the diameter of said beads are spaced axially along the entire length of said support between each pair of said beads.

4. The fire escape device according to claim 1 wherein said hook means are attached to each end of the flexible rope-like support.

5. The fire escape device according to claim 1 wherein said hooks have locking members attached to the forward portions thereof to prevent accidental disengagement of said hooks from said supporting means.

6. The fire escape device according to claim 1 wherein said rope-like structure is made of cable, nonflammable plastic, rope or wire.

7. The fire escape device according to claim 1 wherein said beads are phosphorescent.

8. An exercise device designed to depend vertically from wall or ceiling comprising in combination a thin elongated flexible rope-like support of uniform diameter having a multiplicity of beads with holes bored therethrough, each about 4 to 5 inches in diameter spaced along substantially the entire length of said support, supporting each other, and freely movable thereon, horizontal members having a length about two times the diameter of said beads attached to said rope-like support above and below said beads on said support, and hook means attached to at least one end of said support for attachment of said exercise device to a supporting means on a wall or ceiling.

9. An amusement device designed to be attached at one or both ends to a support means on a wall, a ceiling or free standing member comprising in combination a thin elongated flexible rope-like support of uniform diameter having a multiplicity of beads with holes bored therethrough, each about 4 to 5 inches in diameter, spaced along substantially the entire length of said support, supporting each other, and freely movable thereon, horizontal members having a length about two times the diameter of said beads attached to said rope-like support above and below said beads on said support and grasping hook means attached to at least one end of said support for attachment of said amusement device to a supporting means on a wall, a ceiling or a free standing member.

* * * * *